United States Patent [19]

Christian et al.

[11] 4,321,415

[45] Mar. 23, 1982

[54] HEATING ELEMENT SUPPORT FOR VACUUM ELECTRIC FURNACES

[75] Inventors: Robert A. Christian, Willow Grove; Edward N. Cyrway, Jr., Levittown, both of, PA

[73] Assignee: Abar Corporation, Feasterville, Pa.

[21] Appl. No.: 178,860

[22] Filed: Aug. 18, 1980

[51] Int. Cl.[3] ..... F27B 5/14; H05B 3/06

[52] U.S. Cl. ..... 13/25

[58] Field of Search ..... 13/20, 25, 31; 219/390, 219/405, 343, 347

[56] References Cited

U.S. PATENT DOCUMENTS

| | | | |
|---|---|---|---|
| 3,134,836 | 5/1964 | Malinowski | 13/25 |
| 3,456,935 | 7/1969 | Borner | 13/25 UX |
| 3,737,553 | 6/1973 | Kreider et al. . | |
| 3,742,670 | 7/1973 | Byrd, Jr. | 13/25 X |
| 3,812,276 | 5/1974 | Cyrway, Jr. et al. . | |
| 4,259,538 | 3/1981 | Jones | 13/25 |

*Primary Examiner*—Roy N. Envall, Jr.

*Attorney, Agent, or Firm*—Z. T. Wobensmith, 2nd; Z. T. Wobensmith, III

[57] ABSTRACT

A resistance heating element support for vacuum electric furnaces is described for use with such furnaces having a gas plenum chamber and for other vacuum electric furnaces having the support in spaced relation to the outer wall of the furnace, the support being removably carried in a tube extending across the plenum chamber or in an interior reflective shield carried on a supporting ring, the support being normally in locked position but being turnable through an angle for release and removal.

10 Claims, 7 Drawing Figures

HEATING ELEMENT SUPPORT FOR VACUUM ELECTRIC FURNACES

BACKGROUND OF THE INVENTION

1. Field of the Invention

This invention relates to removable supports for resistance heating elements of vacuum electric furnaces.

2. Description of the Prior Art

It has heretofore been proposed to mount resistance heating elements in the interior of a vacuum electric furnace. Kreider et al., in U.S. Pat. Nos. 3,737,553 and Cyrway et al., in U.S. Pat. No. 3,812,276 show such mountings.

In the event of difficulty close to the furnace wall it was necessary to remove the heating elements and then remove the remainder of the supports for access to the mountings close to the furnace wall.

SUMMARY OF THE INVENTION

In accordance with the invention a support for a heating element of a vacuum electric furnace is provided, the support including a pair of spaced strips or plates mounted at their inner ends on ceramic insulators which carry the heating elements, the strips or plates being retained in spaced parallel relation, and being supported at their outer ends by a sleeve with a transverse pin, the strips having notches for engagement with the pin and being rotatable for unlocking for withdrawal from the sleeve.

It is the principal object of the invention to provide an improved support for a heating element of a vacuum electric furnace and which is detachably mounted for ease of removal.

It is a further object of the invention to provide an improved support for a heating element of a vacuum electric furnace which is simple in construction but which is reliable in use.

It is a further object of the invention to provide an improved support for a heating element of a vacuum electric furnace which has fewer parts than have heretofore been required.

It is a further object of the invention to provide an improved support for a heating element of a vacuum electric furnace in which metalizing of the support is delayed or prevented.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
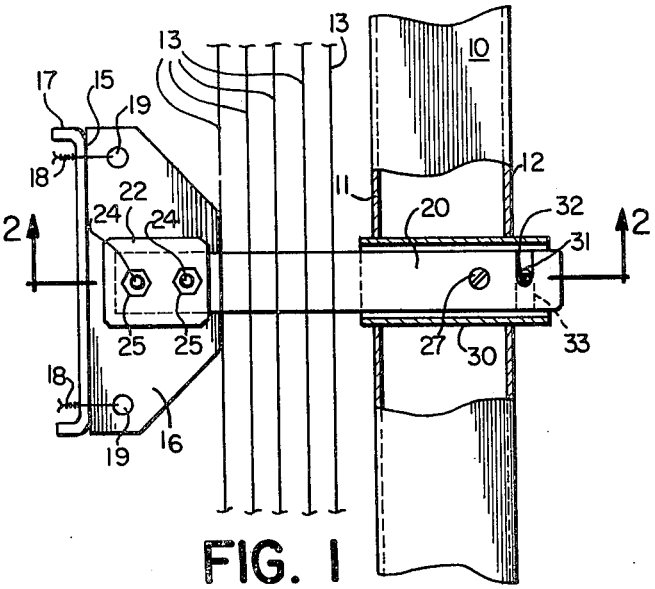
FIG. 1 is a fragmentary horizontal sectional view, taken approximately on the line 1—1 of FIG. 2 showing the support mounted in a sleeve through a plenum chamber.
Figure 3:
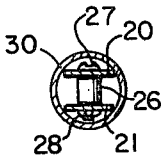
FIG. 3 is a sectional view taken approximately on the line 3—3 of FIG. 2.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now to FIGS. 1 to 5 of the drawings the support there shown is for a vacuum electric furnace having an interior gas plenum chamber 10 with spaced side walls 11 and 12 and a plurality of reflective shields 13 for heat retention within the furnace.

The resistance heating element 15, which is preferably an elongated continuous thin flat strip of high temperature refractory material such as nickel, molybdenum, columbium, tantalum, tungsten, tantalum-tungsten alloys, tungsten-rhenium alloys, rhenium, osmium, iridium, or alloys including binary or ternary alloys of these metals, or conductive non-metals so long as they have the desired resistivity and the desired temperature resistant qualities in use.

The resistance heating element 15 is supported at a plurality of locations around the interior of the furnace and is retained in place at such locations on a ceramic insulator 16 by a U-shaped clamping rod 17 of desired temperature resistant qualities, such as molydenum, by wires 18 of molybdenum, which extend through openings 19 in the ceramic insuator 16.

The ceramic insulator 16 has extending therefrom a pair of spaced strips 20 and 21 of high temperature refractory material with metallizing shields 22 and 23 of high temperature refractory material exteriorly disposed and held in clamped relation by bolts 24 and nuts 25 of high temperature refractory material. The strips 20 and 21 are retained in spaced relation at their ends remote from the insulator 16 by a spacer 26, a bolt 27 extending through the strips 20 and 21, the spacer 26 and a nut 28.

A tubular sleeve 30 is provided extending through the walls 11 and 12 of the plenum chamber 10, and beyond the wall 12, and has oppositely spaced holes 31 for the reception of a pin 32, such as a cotter pin, of stainless steel or the like. The strips 20 and 21 have notches 33 and 34 extending inwardly from opposite edges thereof so that upon turning of the ceramic insulator 16 through a ninety degree angle the notches 33 and 34 can be engaged or disengaged with the pin 32.

Figure 5:
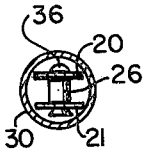
FIG. 5 is a sectional view taken approximately on the line 5—5 of FIG. 4.
Figure 2:
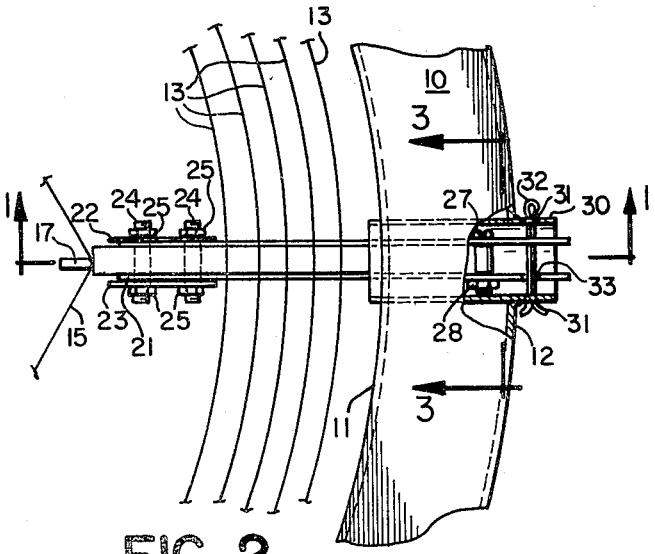
FIG. 2 is a vertical sectional view taken approximately on the line 2—2 of FIG. 1.
Figure 4:
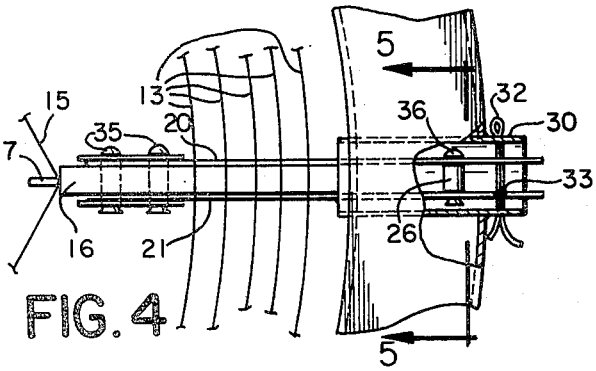
FIG. 4 is a view similar to FIG. 2 but showing a different arrangement for spacing the strips or plates.

If desired, and as illustrated in FIGS. 4 and 5, in place of the bolts 24 and nuts 25, rivets 35 of high temperature refractory material can be employed, and in place of the bolt 27 and nut 28, a rivet 36 of stainless steel or high temperature refractory material extending through the strips 20 and 21 and the spacer 26 can be used.

Figure 6:
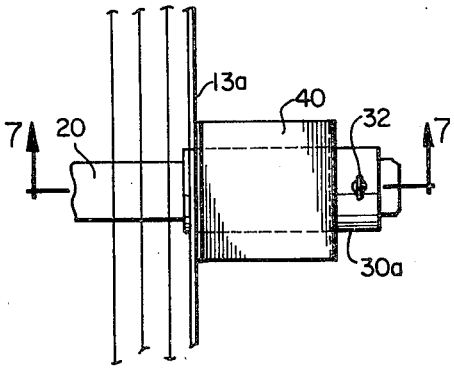
FIG. 6 is a fragmentary plan view showing a different support for detachable mounting.
Figure 7:
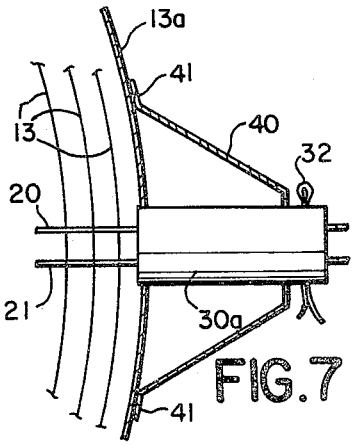
FIG. 7 is a fragmentary sectional view taken approximately on the line 7—7 of FIG. 6.

In FIGS. 6 and 7 another preferred embodiment of the invention is shown suitable for use without a gas plenum, the outermost shield 13*a* being made thicker and provided with a supporting frame 40 with ends 41 secured to the outermost shield 13*a*, the sleeve 30*a* for the reception and retention of the ends of the strips 20 and 21 being secured to the outermost shield 13*a* and to the frame 40, the strips 20 and 21 being provided with notches 33 and 34 as previously described for engagement or disengagement with a pin 32.

If access to the supports is desired it is necessary to separate or remove heating element 15 by severing the wires 18, and removing the clamping rod 17. Access may then be had to the ceramic insulator 16 so that it can be turned to disconnect the notches 33 and 34 from the pin 32. The insulator 16 and strips 20 and 21 can then be moved inwardly along the tubular sleeve 30 or 30*a*. The structure can be reassembled by a reversal of the operations previously described.

We claim:

1. A support for a heating element for a vacuum electric furnace which comprises a tubular sleeve in said furnace having an abutment therein, supporting members for the heating element comprising spaced strips for partial insertion in said sleeve, said strips having portions for engagement with said abutment in one position and for disengagement in another position.

2. A support as defined in claim 1 in which said tubular sleeve is mounted in a gas plenum.

3. A support as defined in claim 1 in which said tubular sleeve is carried by a supporting member.

4. A support as defined in claim 1 in which said tubular sleeve is carried by a shielding member.

5. A support as defined in claim 1 in which said abutment is a pin.

6. A support as defined in claim 1 in which said abutment is a pin extending across said sleeve.

7. A support as defined in claim 5 in which said supporting members for said heating element have notches for engagement with said pin.

8. A support as defined in claim 1 in which said supporting members comprise an insulator carrying said spaced strips, and said heating element is detachably mounted on said insulator.

9. A support as defined in claim 8 in which said strips in spaced relation to said insulator are retained in spaced relation.

10. A support as defined in claim 1 in which said abutment in said tubular sleeve is a diametrically disposed pin, and said spaced strips are held in spaced relation and have notches for engagement with said pin.

* * * * *